US011746773B2

(12) United States Patent
Mou et al.

(10) Patent No.: US 11,746,773 B2
(45) Date of Patent: Sep. 5, 2023

(54) GAS TRANSPORTATION DEVICE

(71) Applicant: Microjet Technology Co., Ltd., Hsinchu (TW)

(72) Inventors: Hao-Jan Mou, Hsinchu (TW); Shih-Chang Chen, Hsinchu (TW); Jia-Yu Liao, Hsinchu (TW); Chun-Lung Tseng, Hsinchu (TW); Yung-Lung Han, Hsinchu (TW); Chi-Feng Huang, Hsinchu (TW); Chang-Yen Tsai, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 0 days.

(21) Appl. No.: 17/649,075

(22) Filed: Jan. 27, 2022

(65) Prior Publication Data

US 2023/0034620 A1 Feb. 2, 2023

(30) Foreign Application Priority Data

Jul. 23, 2021 (TW) ..... 110127150

(51) Int. Cl.
*F04B 45/047* (2006.01)
*F04B 53/10* (2006.01)
*F04B 53/16* (2006.01)

(52) U.S. Cl.
CPC ..... *F04B 45/047* (2013.01); *F04B 53/1067* (2013.01); *F04B 53/16* (2013.01)

(58) Field of Classification Search
CPC ..... F04B 43/046; F04B 45/047; F04B 53/16; F04B 53/1067
See application file for complete search history.

(56) References Cited

U.S. PATENT DOCUMENTS 4,039,002 A * 8/1977 Broyan ..... F04B 39/108 137/516.17
2002/0127736 A1* 9/2002 Chou ..... B01L 3/502738 422/504

(Continued)

FOREIGN PATENT DOCUMENTS

| | | | |
|---|---|---|---|
| CN | 109477478 | A | 3/2019 |
| CN | 111492142 | A | 8/2020 |
| TW | M582533 | U | 8/2019 |

OTHER PUBLICATIONS

Extended European Search Report for European Application No. 22153874.7, dated Jun. 21, 2022.

*Primary Examiner* — Connor J Tremarche
(74) *Attorney, Agent, or Firm* — BIRCH, STEWART, KOLASCH & BIRCH, LLP

(57) ABSTRACT

A gas transportation device is provided and includes an outer housing, a valve body and an actuator. The valve body includes a gas outlet plate, a valve plate and a first plate. The gas outlet plate includes plural outlet apertures, the first plate includes plural first orifices, the valve plate includes plural valve openings, the plural valve openings are misaligned with the plural first orifices and corresponding in position to the plural outlet apertures. The actuator having an actuating component in rectangular shape is stacked and disposed on the valve body. When the actuator is driven, through the structure that the plural first orifices and the plural valve openings are misaligned, the valve body is operated to open a flow path when an airflow is in a forward direction, and the valve body is operated to seal the flow path when the airflow is in a reverse direction.

21 Claims, 12 Drawing Sheets

(56) References Cited

U.S. PATENT DOCUMENTS

| | | | | |
|---|---|---|---|---|
| 2013/0276906 | A1* | 10/2013 | Locke | F16K 15/14 137/15.01 |
| 2015/0150470 | A1 | 6/2015 | Sano et al. | |
| 2017/0218949 | A1 | 8/2017 | Yokoi et al. | |
| 2018/0187672 | A1* | 7/2018 | Tanaka | F04B 43/02 |
| 2018/0324519 | A1* | 11/2018 | Park | H04R 23/02 |
| 2018/0347557 | A1* | 12/2018 | Chen | F16K 7/12 |
| 2019/0056367 | A1* | 2/2019 | Mou | H05K 5/065 |
| 2019/0226472 | A1* | 7/2019 | Tanaka | F04B 39/10 |
| 2020/0318630 | A1* | 10/2020 | Kondo | F04B 43/046 |

* cited by examiner

GAS TRANSPORTATION DEVICE

FIELD OF THE INVENTION

The present disclosure relates to a gas transportation device, and more particularly to a high-flow gas transportation device.

BACKGROUND OF THE INVENTION

Currently, in various fields, such as pharmaceutical industries, computer techniques, printing industries or energy industries, the products are developed toward elaboration and miniaturization. The gas transportation devices are important components that are used in, for example, micro pumps, micro atomizers, printheads or the industrial printers. Therefore, how to utilize an innovative structure to break through the bottleneck of the prior art has become an important issue of development.

With the rapid development of science and technology, the applications of gas transportation devices are becoming more and more diversified. For example, gas transportation devices are gradually popular in industrial applications, biomedical applications, medical care applications, electronic cooling applications and so on, or even the wearable devices. It is obvious that the gas transportation devices gradually tend to miniaturize the structure and maximize the flow rate thereof.

However, although the current gas transportation device tends to maximize the flow rate, the main structural design object thereof is to prevent the backflow and generate a unidirectional airflow. Therefore, how to provide a high-flow gas transportation device becomes an important research and development topic of the present disclosure.

SUMMARY OF THE INVENTION

An object of the present disclosure is to provide a gas transportation device including a gas outlet plate, a valve plate, a first plate, a second plate and a square actuating component, which are sequentially stacked and assembled. A valve body is configured by the valve plate, the first plate and the second plate collaboratively. When an airflow is in the forward direction, the valve body is operated to open a flow path, and when the airflow is in the reverse direction, the valve body is operated to seal the flow path, thereby the phenomenon of backflow can be effectively prevented to generate a unidirectional airflow and obtain a high-flow gas transportation device.

In accordance with an aspect of the present disclosure, a gas transportation device includes an outer housing, a valve body and an actuator is provided. The outer housing includes a case and a top cover. The case includes an inlet end, an outlet end and an accommodation groove, the accommodation groove is in fluid communication with the inlet end and the outlet end, and the top cover is covered on the accommodation groove. The valve body includes a gas outlet plate, a valve plate and a first plate stacked sequentially and disposed within the accommodation groove. The valve plate is located between the gas outlet plate and the first plate. The gas outlet plate includes a plurality of outlet apertures, the first plate comprises a plurality of first orifices, the valve plate includes a plurality of valve openings, the plurality of valve openings are misaligned with the plurality of first orifices, and the plurality of valve opening are corresponding in position to the plurality of outlet apertures. The actuator includes a second plate, a frame and an actuating component. The second plate is stacked and disposed on the valve body, and the thickness of the second plate is greater than the thickness of the first plate. The second plate includes a plurality of second orifices, and the plurality of second orifices are corresponding in position to the plurality of first orifices. The frame is stacked and disposed on the second plate. The actuating component in a rectangular shape is stacked and disposed on the frame. When the actuator is driven, through the misalignment of the plurality of first orifices and the plurality of valve openings, the valve body is operated to open a flow path when an airflow is in a forward direction, and the valve body is operated to seal the flow path when the airflow is in a reverse direction.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
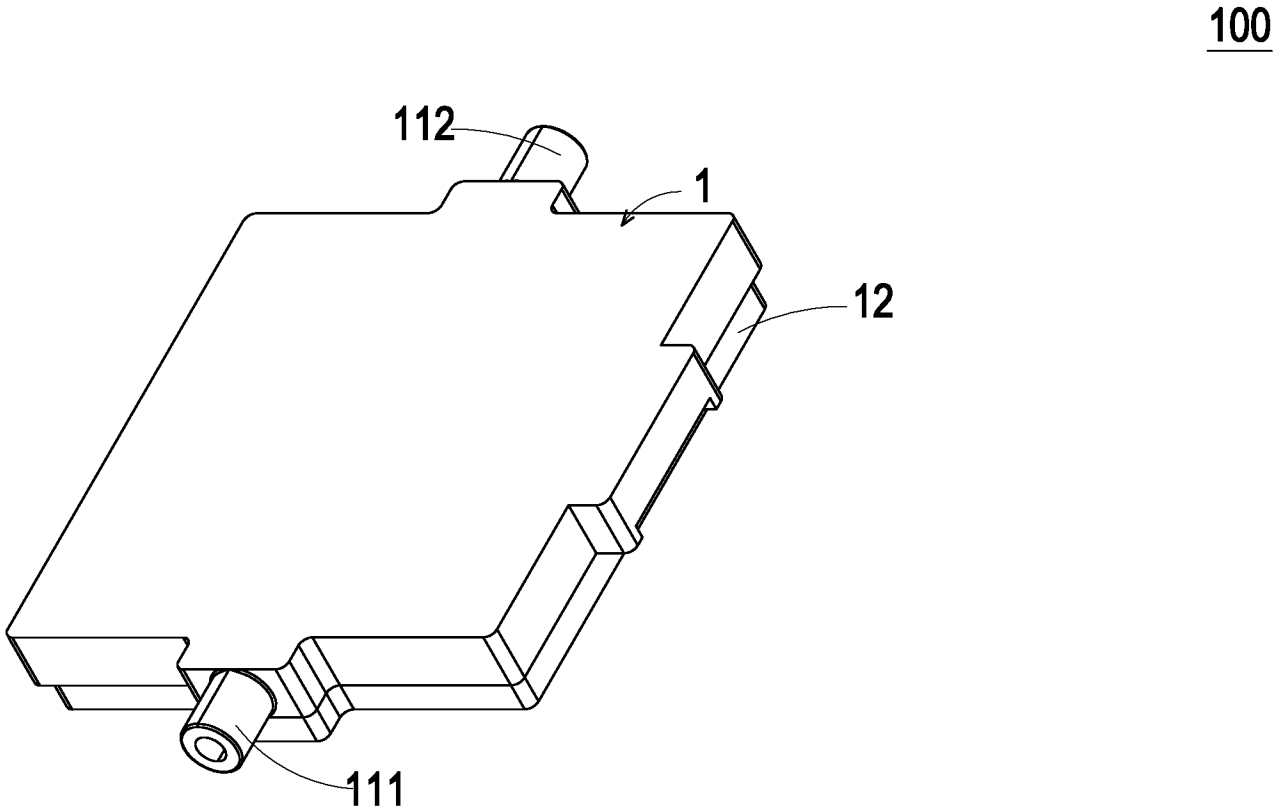
FIG. 1A is a schematic exterior view illustrating a gas transportation device according to an embodiment of the present disclosure.
Figure 1B:
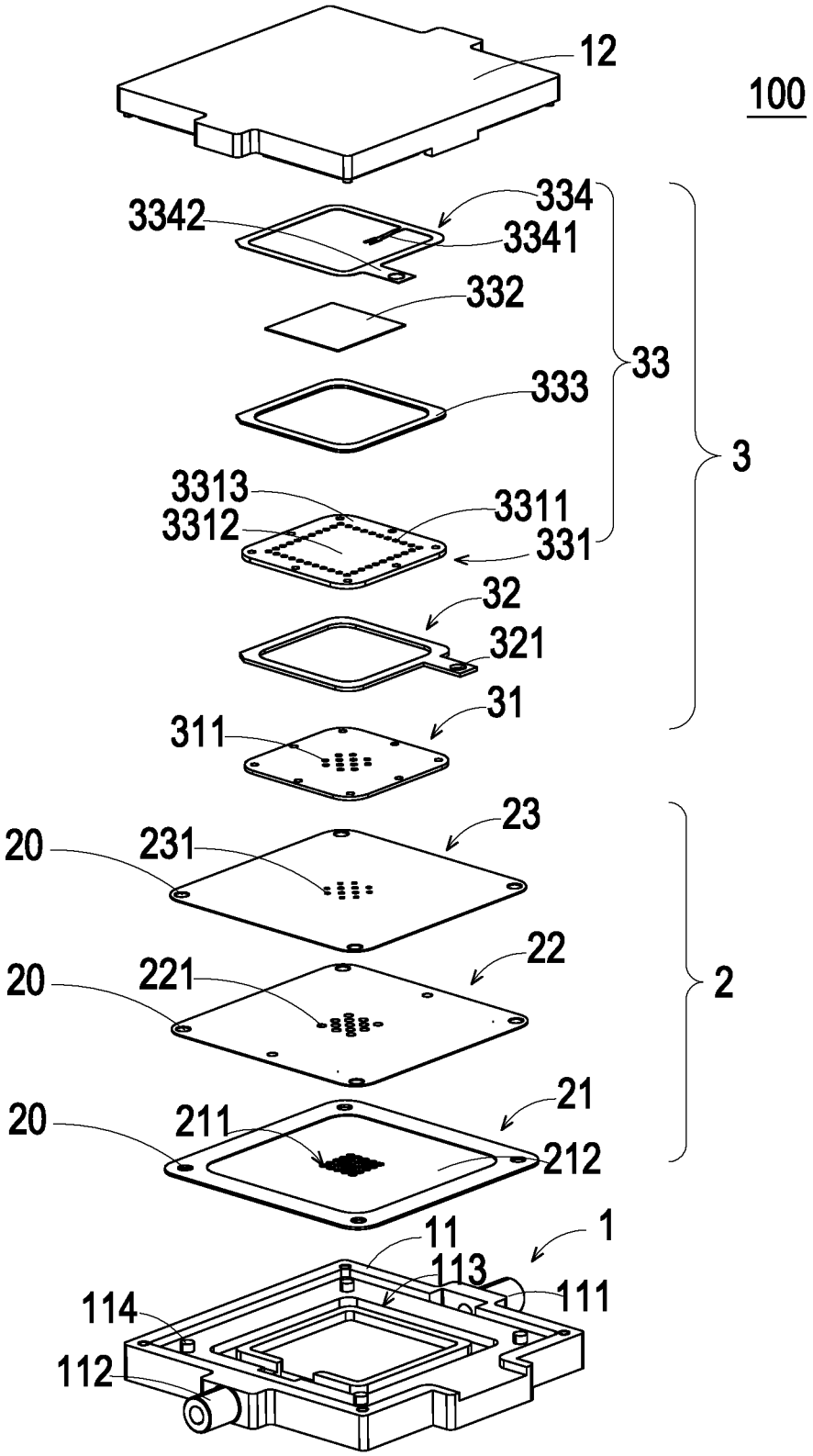
FIG. 1B is a schematic exploded view illustrating the gas transportation device according to the embodiment of the present disclosure.
Figure 2A:
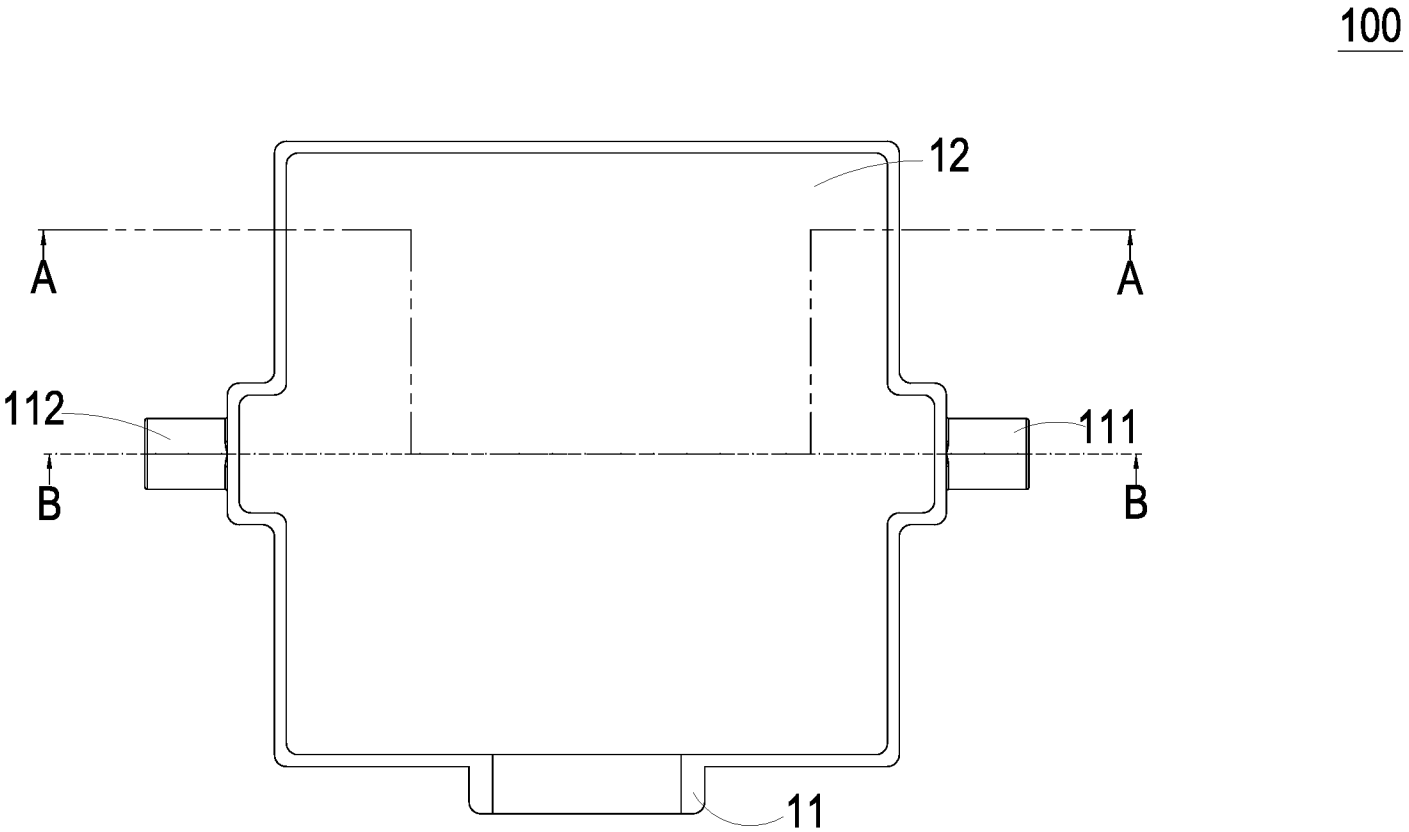
FIG. 2A is a top view illustrating the gas transportation device according to the embodiment of the present disclosure.
Figure 2B:
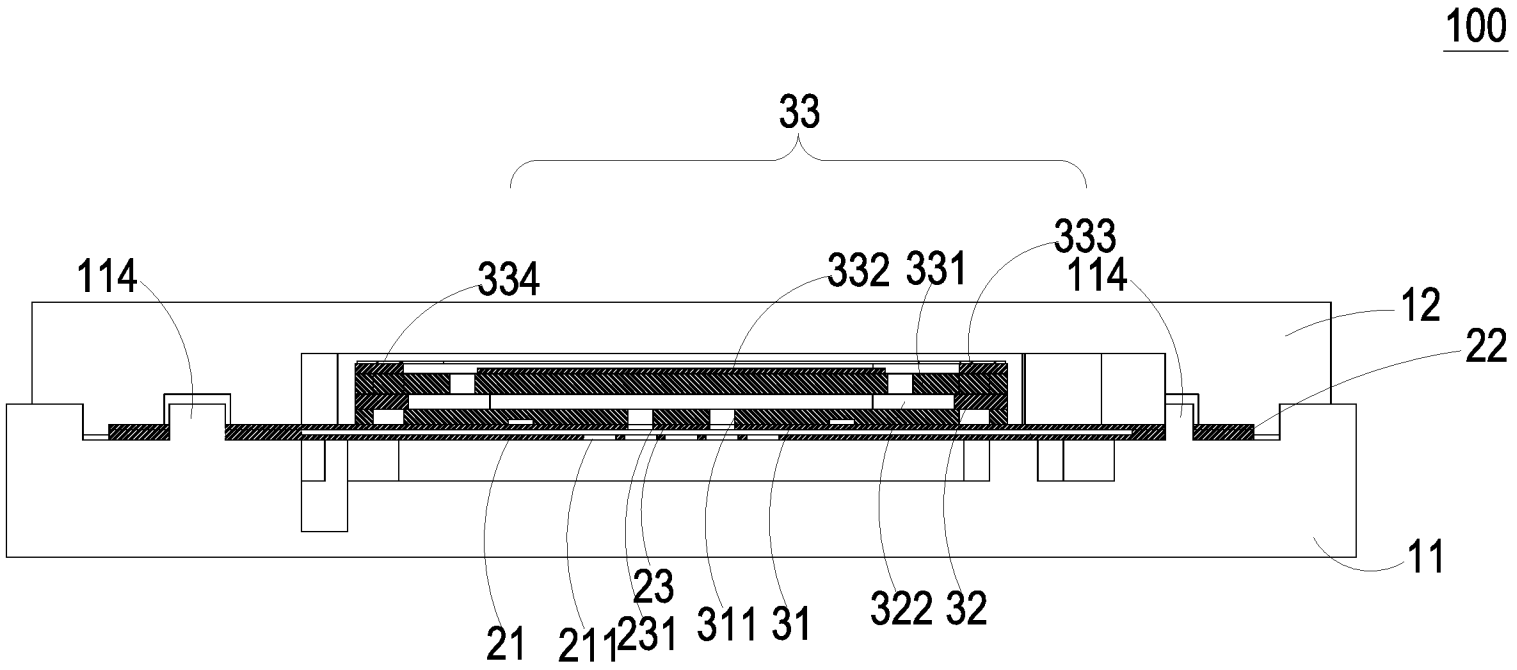
FIG. 2B is a schematic cross-sectional view taken from the line A-A in FIG. 2A.
Figure 2C:
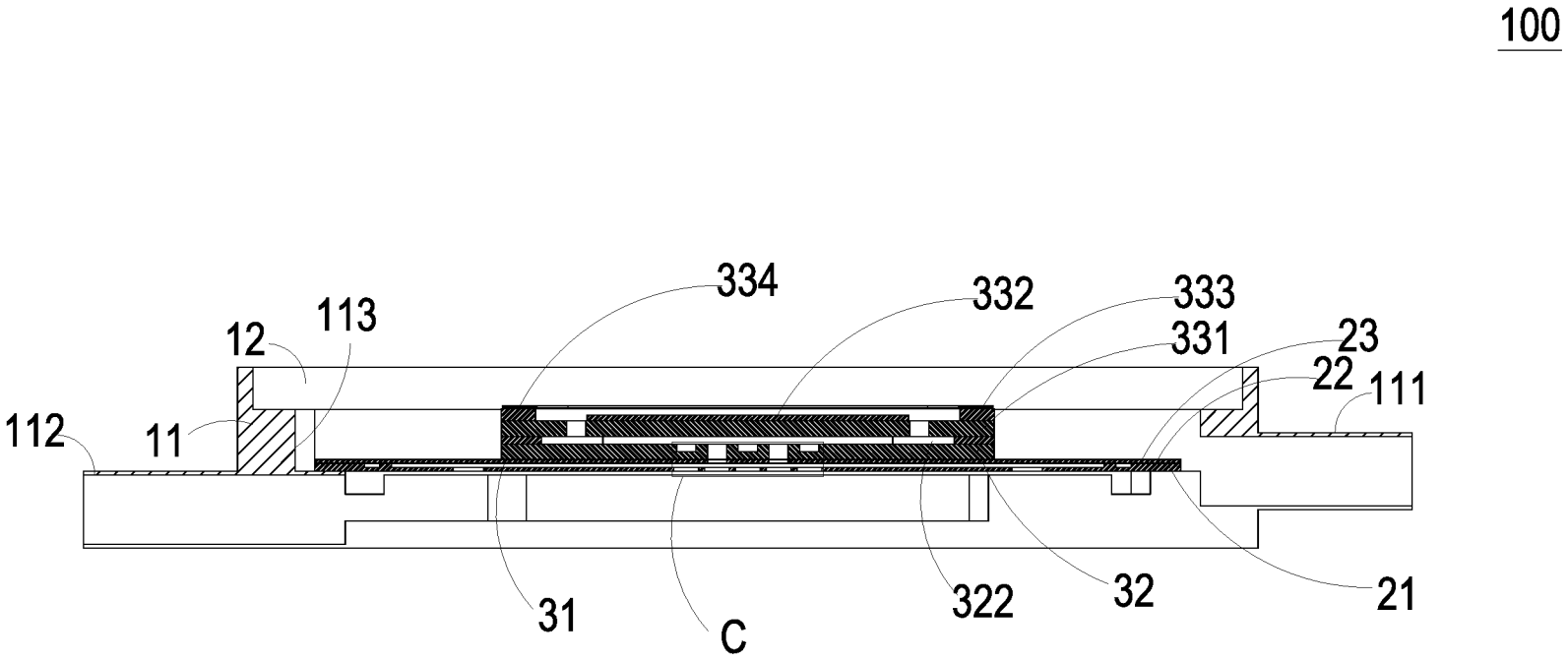
FIG. 2C is a schematic cross-sectional view taken from the line B-B in FIG. 2A.
Figure 2D:
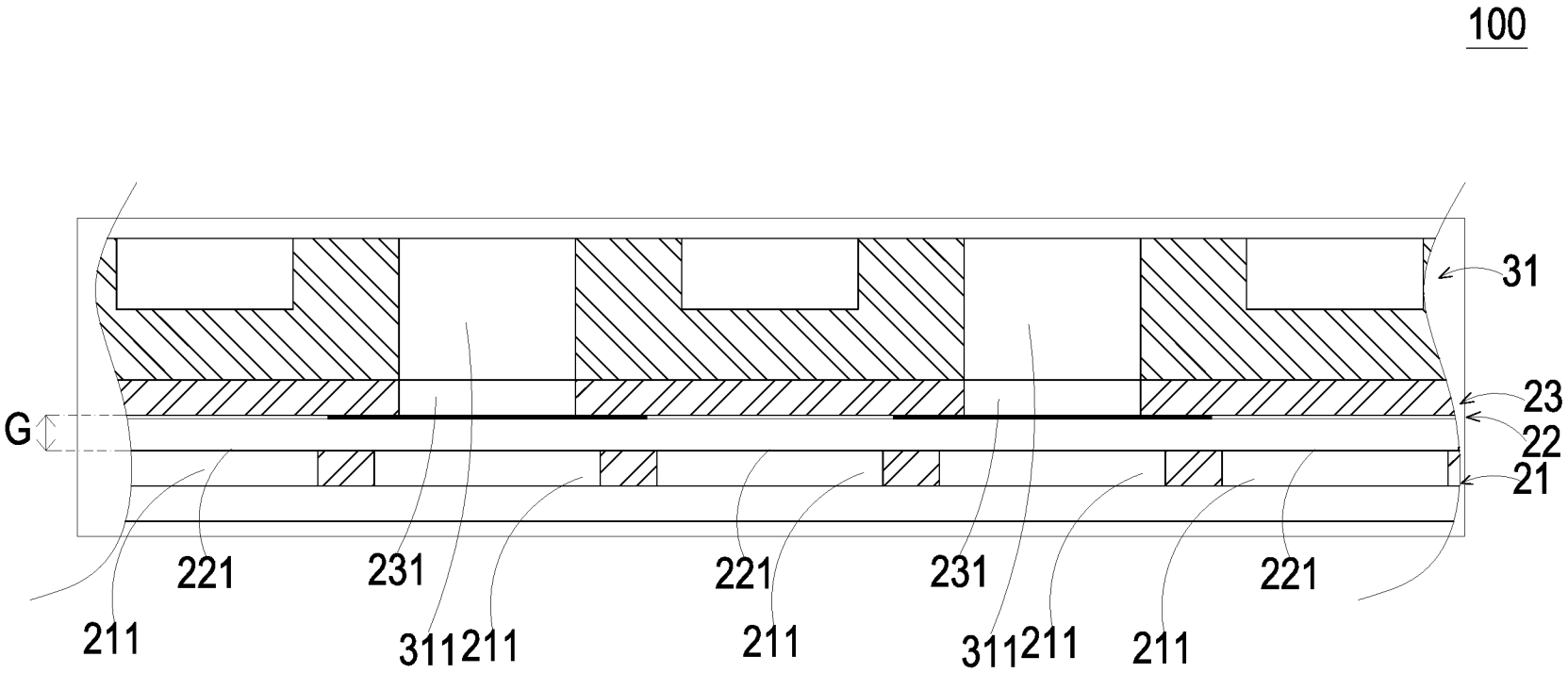
FIG. 2D is a schematic partial cross-sectional view of the region C in FIG. 2C.

The present disclosure provides a gas transportation device 100. Please refer to FIG. 1A, FIG. 1B and FIG. 2A. In the embodiment, the gas transportation device 100 includes an outer housing 1, a valve body 2 and an actuator 3.

In the embodiment, the outer housing 1 includes a case 11 and a top cover 12. Preferably but not exclusively, the case 11 is a square box and includes an inlet end 111, an outlet end 112, an accommodation groove 113 and a plurality of positioning protrusions 114. The inlet end 111 and the outlet end 112 are disposed on two opposite lateral walls of the case 11, and in fluid communication with the accommodation groove 113. The plurality of positioning protrusions 114 are disposed within the accommodation groove 113. In the embodiment, there are four positioning protrusions 114, which are disposed at four corners of the accommodation groove 113, but not limited thereto. The top cover 12 is fixed to the case 11 and covers the accommodation groove 113.

Please refer to FIG. 1, FIG. 1B and FIGS. 2A to 2D. In the embodiment, the valve body 2 includes a gas outlet plate 21, a valve plate 22 and a first plate 23, which are stacked sequentially and disposed within the accommodation groove 113. The valve plate 22 is disposed between the gas outlet plate 21 and the first plate 23. Each of the gas outlet plate 21, the valve plate 22 and the first plate 23 includes a plurality of positioning holes 20, respectively, and each positioning hole 20 is corresponding in position to the respective positioning protrusion 114. In this way, the respective positioning holes 20 of the gas outlet plate 21, the valve plate 22 and the first plate 23 are incorporated into the corresponding positioning protrusion 114 of the case 11, so as to be positioned and assembled to the valve body 2, which execute the functions of preventing the reverse flow and generating a unidirectional airflow. In the embodiment, the gas outlet plate 21, the first plate 23 are a metallic plate, respectively. Preferably but not exclusively, the valve plate 22 is a flexible membrane, and the thickness of the valve plate is ranged from 0.4 μm to 0.6 μm and most preferably, the thickness of the valve plate is 0.5 μm. Preferably, but not exclusively, the valve plate 22 is a polyimide membrane.

In the embodiment, the gas outlet plate 21 includes a plurality of outlet apertures 211, and the first plate 23 includes a plurality of first orifices 231, and the valve plate 22 includes a plurality of valve openings 221. The plurality of valve openings 221 are misaligned with the plurality of first orifices 231, so that the valve plate 22 is allowed to seal the plurality of first orifices 231. In the embodiment, the plurality of valve openings 221 are corresponding in position to the plurality of outlet apertures 211, and the diameter d4 of the valve opening 22 is greater than or equal to the diameter d2 of the outlet aperture 211. With such aperture design of the outlet aperture 211, a high-flow airflow passes through the valve openings 221 when the valve body 2 is operated to open a flow path, and then discharges out through the outlet aperture 211 rapidly. Moreover, in the embodiment, the gas outlet plate 21 includes a recessed portion 212 recessed from a surface thereof and formed a depth, and the valve plate 22 covers the gas outlet plate 21, so that a gap G is maintained between the valve plate 22 and the recessed portion 212 of the gas outlet plate 21. In the embodiment, a ratio of the gap G to the thickness of the gas outlet plate 21 is ranged from 1:2 to 2:3. Preferably but not exclusively, the gap G is ranged from 40 μm to 70 μm. Most preferably, in the embodiment, the gap G is 60 μm. With such valve body 2 designed, when the valve plate 22 is shifted towards the first plate 23 and allowed to seal the first orifices 231, the valve body 2 is operated to seal the flow path, as shown in FIG. 3B. Alternatively, when the valve plate 22 is shifted towards the gas outlet plate 21 and allowed to be vibrated in the airflow in the gap G, the valve body 2 is operated to open the flow path, as shown in FIG. 3C, and the airflow (flowing in the path indicated by the arrow) passes through the valve openings 221 and then discharges out through the outlet aperture 211. In this way, the valve body 2 is designed to prevent the phenomenon of backflow, and generate a unidirectional airflow with a high-flow control effect.

In the embodiment, the actuator 3 includes a second plate 31, a frame 32 and an actuating component 33. The second plate 31 is stacked and disposed on the first plate 23. The thickness of the second plate 31 is greater than the thickness of the first plate 23. The second plate 31 includes the plurality of second orifices 311. Notably, the number, the position and the diameter of the second orifices 311 are corresponding to those of the first orifices 231. In the embodiment, the diameter of the second orifices 311 is equal to the diameter of the first orifices 231. In the embodiment, the frame 32 further includes a leading pin 321 for the electrical connection of the wires. Preferably but not exclusively, in the embodiment, the second plate 31 is a metallic plate.

In the embodiment, the frame 32 is disposed and positioned on the second plate 31, and the actuating component 33 is disposed and positioned on the frame 32. In the embodiment, the actuating component 33 includes a gas inlet plate 331, a piezoelectric plate 332, an insulation frame 333 and a conductive frame 334.

In the embodiment, the gas inlet plate 331 includes a plurality of inlet apertures 3311. The plurality of inlet apertures 3311 are arranged in a specific shape on a plane of the gas inlet plate 331. In the embodiment, the plurality of inlet apertures 3311 are arranged in a square shape, and an actuation portion 3312 and a fixed portion 3313 are defined on the plane of the gas inlet plate 331 through the arranged shape of the plurality of inlet apertures 3311. The actuation portion 3312 is surrounded by the plurality of inlet apertures 3311, and the fixed portion 3313 is surrounding the periphery of the plurality inlet apertures 3311. In the embodiment, the plurality of inlet apertures 3311 are tapered to improve the air intake efficiency, and such structure is easy to enter and difficult to exit for the airflow, thereby result in the effect of preventing the phenomenon of backflow. Preferably but not exclusively, the number of the inlet apertures 3311 is an even number. In an embodiment, the number of the inlet apertures 3311 is forty-eight. In another embodiment, the number of the inlet apertures 3311 is fifty-two, but not limited thereto. Furthermore, in other embodiments, the plurality of inlet apertures 3311 are arranged in various shapes such as rectangle, square, circle, and etc.

In the embodiment, the piezoelectric plate 332 is in a square shape. The piezoelectric plate 332 is disposed on the actuation portion 3312 of the gas inlet plate 331. The piezoelectric plate 332 is corresponding in position to the actuation portion 3312 of the gas inlet plate 331. In the embodiment, as the plurality of inlet apertures 3311 are arranged in a square shape, the actuation portion 3312 is defined as a square shape, and the piezoelectric plate 332 is square, too. In other embodiments, the arranged shape of the inlet apertures 3311 is selected from the group consisting of rectangle, square and circle, the shape of the actuation portion 3312 is adjusted according to the arrangement of the inlet apertures 3311, and the piezoelectric plate 332 is corresponding to the shape of the actuation portion 3312.

In the embodiment, the insulation frame 333 is disposed on the fixed portion 3313 of the gas inlet plate 331. The conductive frame 334 is disposed on the insulation frame 333. In addition, the conductive frame 334 includes a conducting electrode 3341 and a conducting pin 3342. The conducting electrode 3341 is electrically contacted with the piezoelectric plate 332. The conducting pin 3342 is externally connected to a wire. Preferably but not exclusively, the gas inlet plate 331 is formed by a conductive material and in electrical contact with the piezoelectric plate 332, and a leading pin 321 of the frame 32 is connected to another wire, thereby the driving circuit of the actuating component 33 is completed. In the embodiment, the driving signal of the gas transportation device 100 is transmitted through two wires. One wire connected to the conducting pin 3342 of the conductive 334 transmits the driving signal through the conducting electrode 3341 to the piezoelectric plate 332, and the other wire connected to the leading pin 321 of the frame 32 transmits the driving signal to the piezoelectric plate 322 through the attached contact between the frame 32 and the gas inlet plate 331 and the attached contact between the gas inlet plate 331 and the piezoelectric plate 322. Thereby, the piezoelectric plate 332 receives the driving signal (such as a driving voltage and a driving frequency) to deform, and the actuating component 33 is driven to generate the displacement in the reciprocating manner, as shown in FIG. 3B to FIG. 3C.

In the embodiment, actuating component 33 is in a square shape. Preferably but not exclusively, the shape of the actuating component 33 is square. Therefore, under the same peripheral size of the device, the actuating component 33 in the present disclosure adopts a square design. For the square design of the actuating component 33, the gas inlet plate 331, the piezoelectric plate 332, the insulation frame 333 and the conductive frame 334 are all in the square shape. Compared with the design of the conventional actuating component in a circular shape, the structure of square shape obviously has the advantage of power saving. The power consumption comparison of the different shapes is listed in Table 1.

TABLE 1

| Shape of the actuating component | Working frequency | Power consumption |
|---|---|---|
| Square (Side length 10 mm) | 18 kHz | 1.1 W |
| Circular (Diameter 10 mm) | 28 kHz | 1.5 W |
| Square (Side length 9 mm) | 22 kHz | 1.3 W |
| Circular (Diameter 9 mm) | 34 kHz | 2 W |
| Square (Side length 8 mm) | 27 kHz | 1.5 W |
| Circular (Diameter 8 mm) | 42 kHz | 2.5 W |

The actuating component 33 is the capacitive load operating under the resonant frequency and the power consumption thereof is increased as the frequency raising. Therefore, since the resonance frequency of the actuating component 33 in side-long square type is obviously lower than that of the circular actuating component, the relative power consumption of the actuating component 33 in the square shape is obviously lower than that of circular actuating component. Therefore, compared with the design of the conventional actuating component in a circular shape, the actuating component 33 with the square design of the present disclosure obviously has the advantage of power saving.

Please refer to FIG. 1A, FIG. 1B, FIGS. 2A to 2D, FIGS. 3A to 3C and FIGS. 4A to 4B. In the embodiment, the gas outlet plate 21, the valve plate 22, the first plate 23, the second plate 31 and the actuating component 33 are stacked sequentially and disposed within the accommodation groove 113 of the case 11 of the outer housing 1, and then the top cover 12 is fixed to the case 11 to seal the accommodation groove 113 and constitute the gas transportation device 100. In the embodiment, the gas inlet plate 331, the piezoelectric plate 332, the insulation frame 333 and the conductive frame 334 of the actuating component 33 are stacked sequentially and fixed on the frame 32, so that an inlet chamber 322 is formed between the actuating component 33, the frame 32 and the second plate 31. In addition, the first orifices 231 of the first plate 23 and the second orifices 311 of the second plate 31 are all located under the vertical projection area of the actuation portion 3312 of the gas inlet plate 331, and are vertically corresponding to the actuation portion 3312.

Figure 3A:
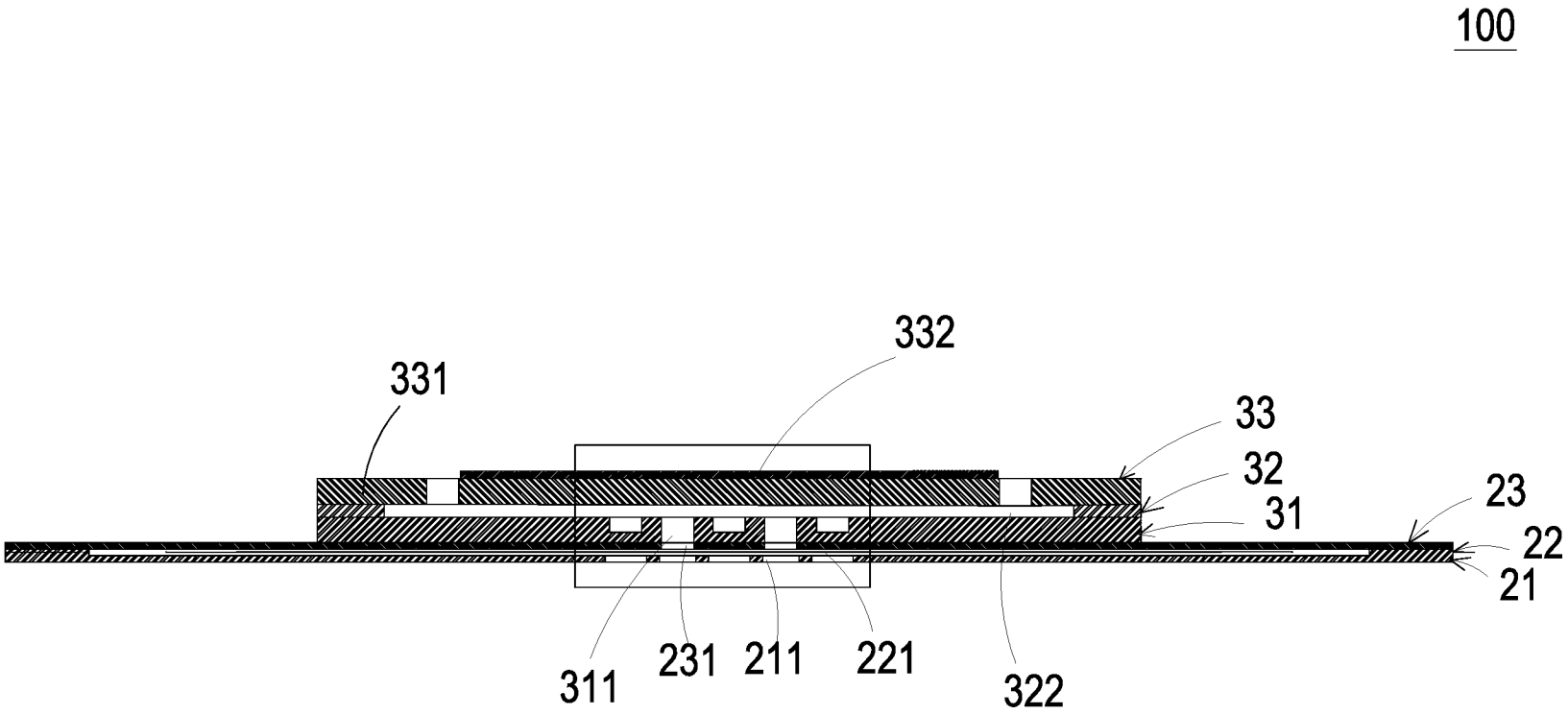
FIGS. 3A to 3C and FIGS. 4A to 4B are cross sectional views illustrating the operation steps of the gas transportation device according to the embodiment of the present disclosure.
Figure 3B:
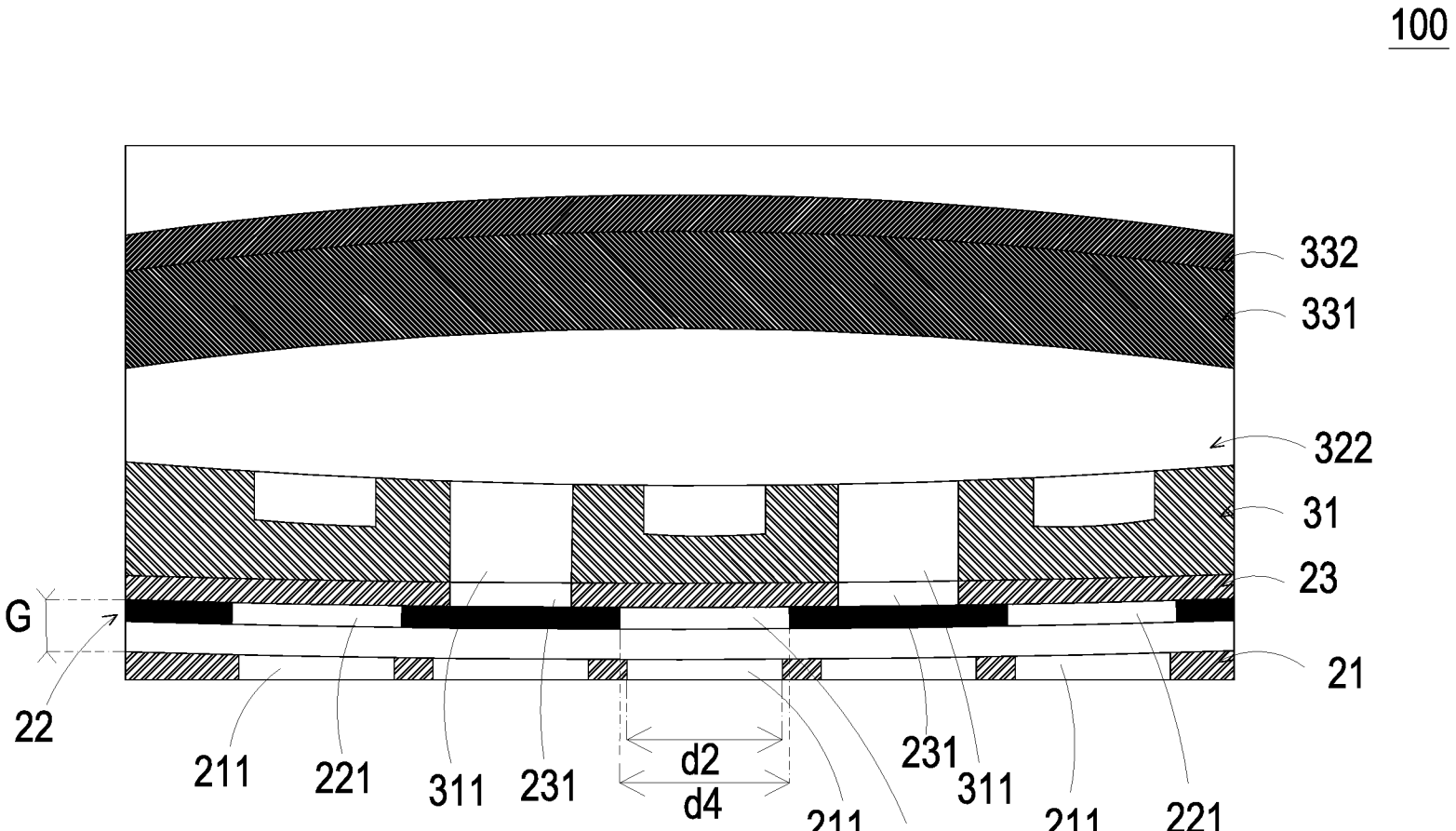
Figure 3C:
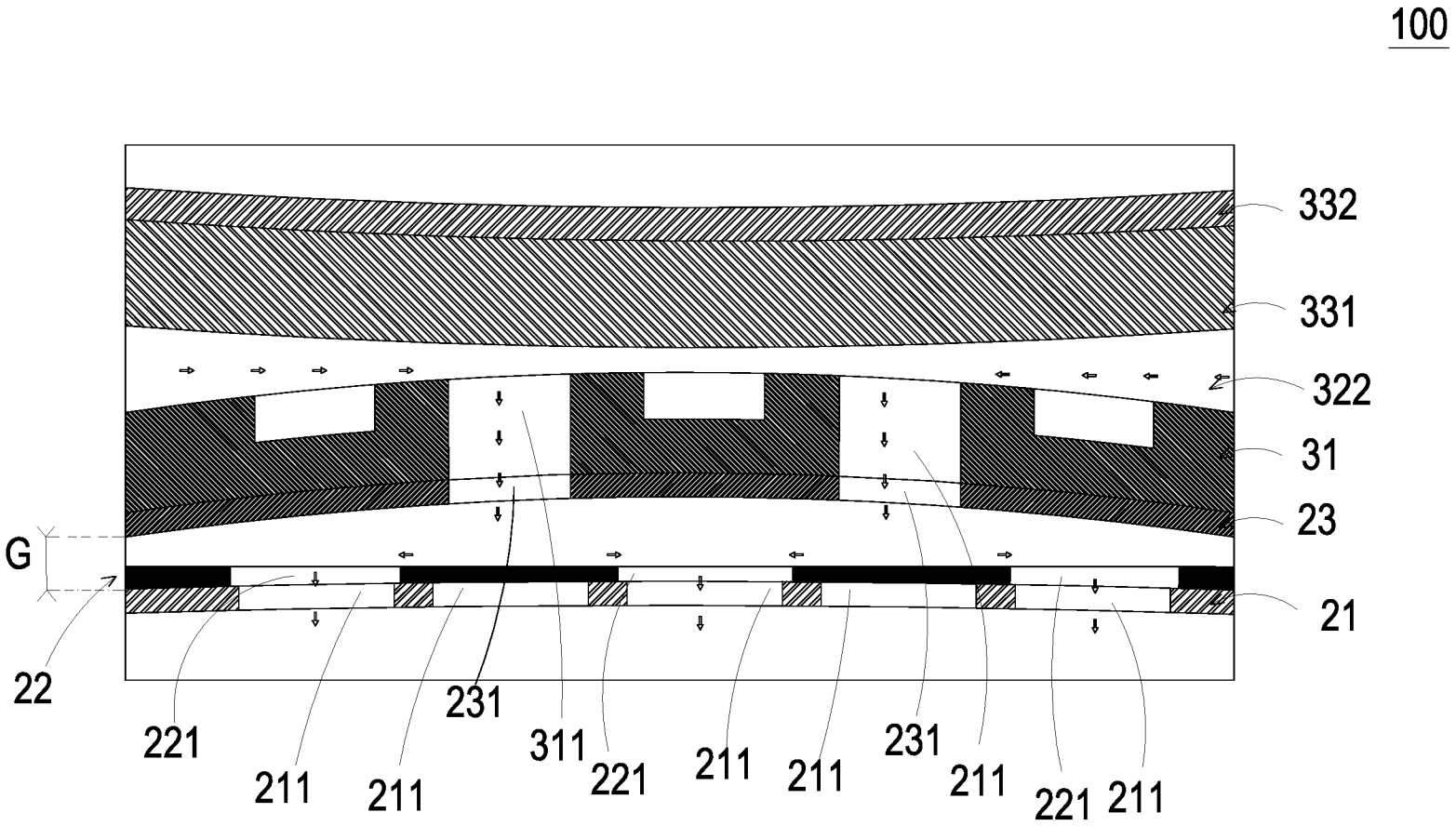

In the specific embodiment of the present disclosure, as shown in FIG. 3A to FIG. 3C, when the piezoelectric plate 332 receives the driving signal (such as a driving voltage and a driving frequency), the electrical energy is converted into the mechanical energy through the inverse piezoelectric effect. The deformation amount of the piezoelectric plate 332 is controlled according to the magnitude of the driving voltage, and the driving frequency is operated to control the deformation frequency of the piezoelectric plate 332. The deformation of the piezoelectric plate 332 drives the actuating component 33 to execute the gas transportation.

Figure 4A:
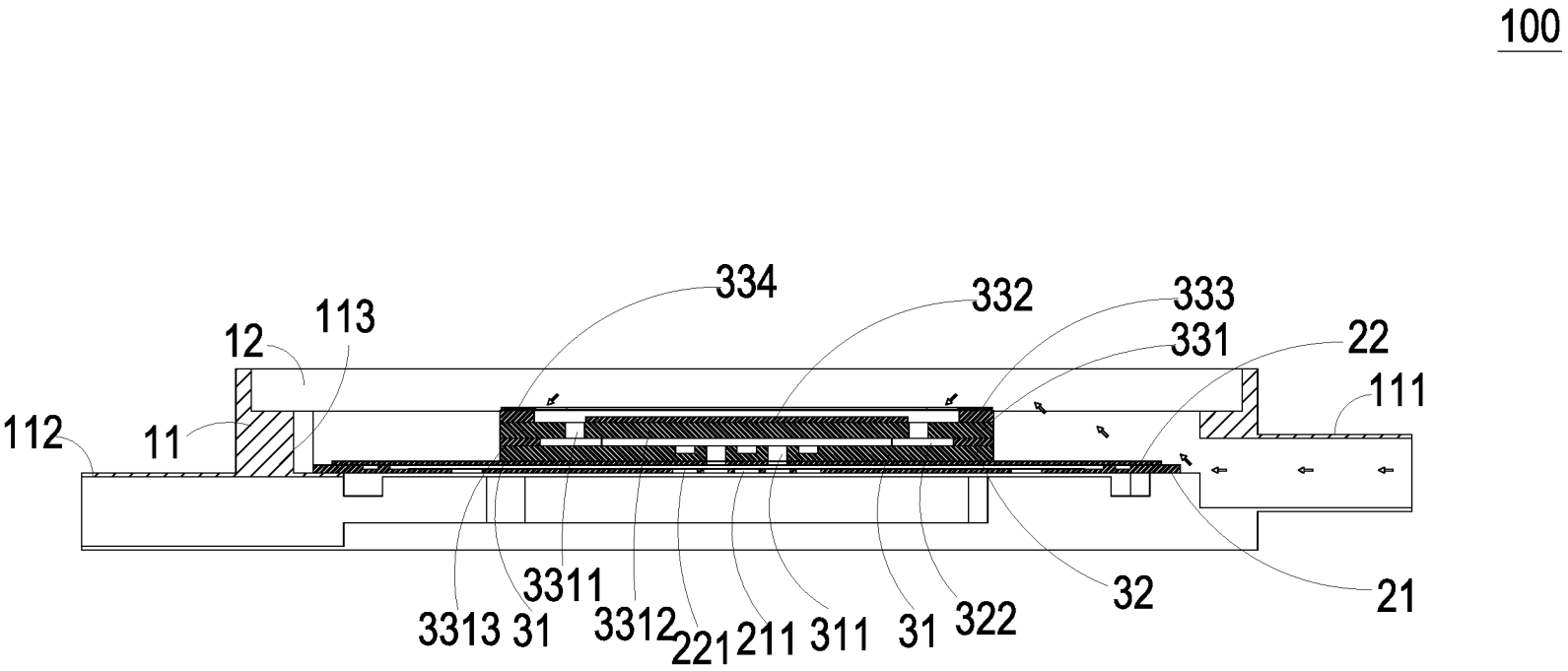
Figure 4B:
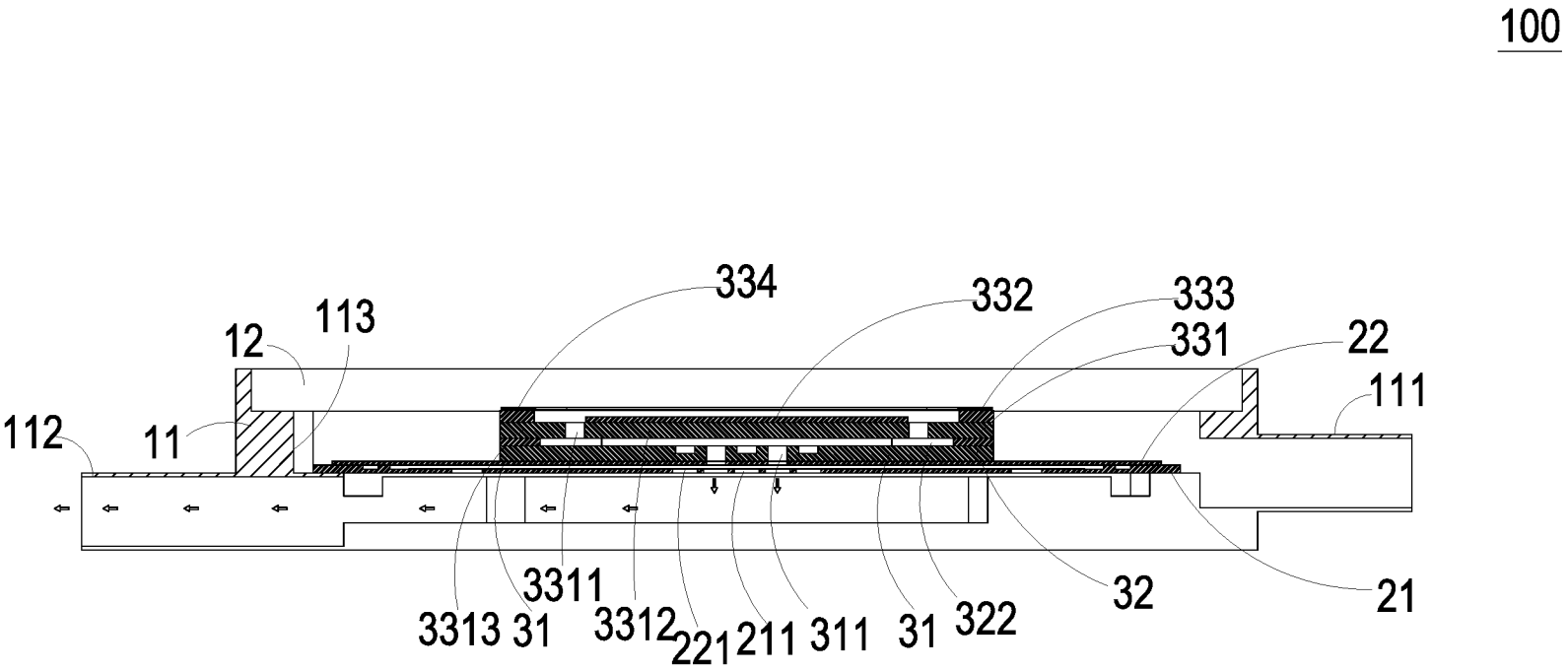

Please refer to FIG. 3B. When the piezoelectric plate 332 receives the driving signal to deform, the gas inlet plate 331 is driven to bend and displace upwardly. At this time, the volume of the inlet chamber 322 is increased, and a negative pressure is generated therein, so that the valve plate 22 is sucked to move upwardly and the first orifices 231 of the first plate 23 are sealed. At the same time, as shown in FIG. 4A, the gas at the side of the inlet end 111 of the case 11 is sucked into the actuating component 33 to enter the inlet chamber 322. Please refer to FIG. 3C. When the piezoelectric plate 332 further receives the driving signal to deform again, the gas inlet plate 331 is driven to bend and displace downwardly, and the inlet chamber 332 is compressed. At this time, as shown in FIG. 4A, the gas at the side of the inlet end 111 of the case 11 is sucked into the actuating component 33, and the gas in the inlet chamber 322 is pushed and transported downwardly through the second orifices 311 of the second plate 31 and the first orifices 231 of the first plate 23, respectively. As the kinetic energy is transmitted downwardly from the actuating component 33 to the gap G, the kinetic energy can push the valve plate 22 to displace, so that the valve plate 22 is separated from the first orifices 231 and abuts against the gas outlet plate 21, thereby achieves the operation of opening the flow path. The gas is then transported downwardly through the valve openings 221 to the outlet apertures 211 of the gas outlet plate 21, and then flows through the outlet apertures 211 to be discharged out through the outlet end 112 of the case 11, as shown in FIG. 4B. Thereafter, as shown in FIG. 3B, when the gas inlet plate 331 is driven by the piezoelectric plate 332 to bend and displace upwardly. The volume of the inlet chamber 322 is increased, and a negative pressure is generated in the inlet chamber 322, so that the valve plate 22 is sucked to move upwardly. As a result, the valve plate 22 seals the first orifices 231 to prevent the gas from flowing back to the inlet chamber 322 through the valve openings 221, the first orifices 231 and the second orifices 311. In addition, when the gas in the accommodation groove 113 flows into the inlet chamber 322, the air pressure in the accommodation groove 113 is lower than the air pressure outside the gas transportation device 100. In that, the gas outside the gas transportation device 100 is introduced into the accommodation groove 113 through the inlet end 111, as shown in FIG. 4A. When the piezoelectric plate 332 further receives the driving signal to deform, and drives the actuating component 33 to displace downwardly, the gas in the inlet chamber 322 is transported downwardly as described above, and finally discharged through the outlet end 112. Through performing the above steps continuously by applying the driving signal, the gas is inhaled through the inlet end 111 and discharged out through the outlet end 112 rapidly, so as to achieve the effect of high-flow amount.

Figure 5:
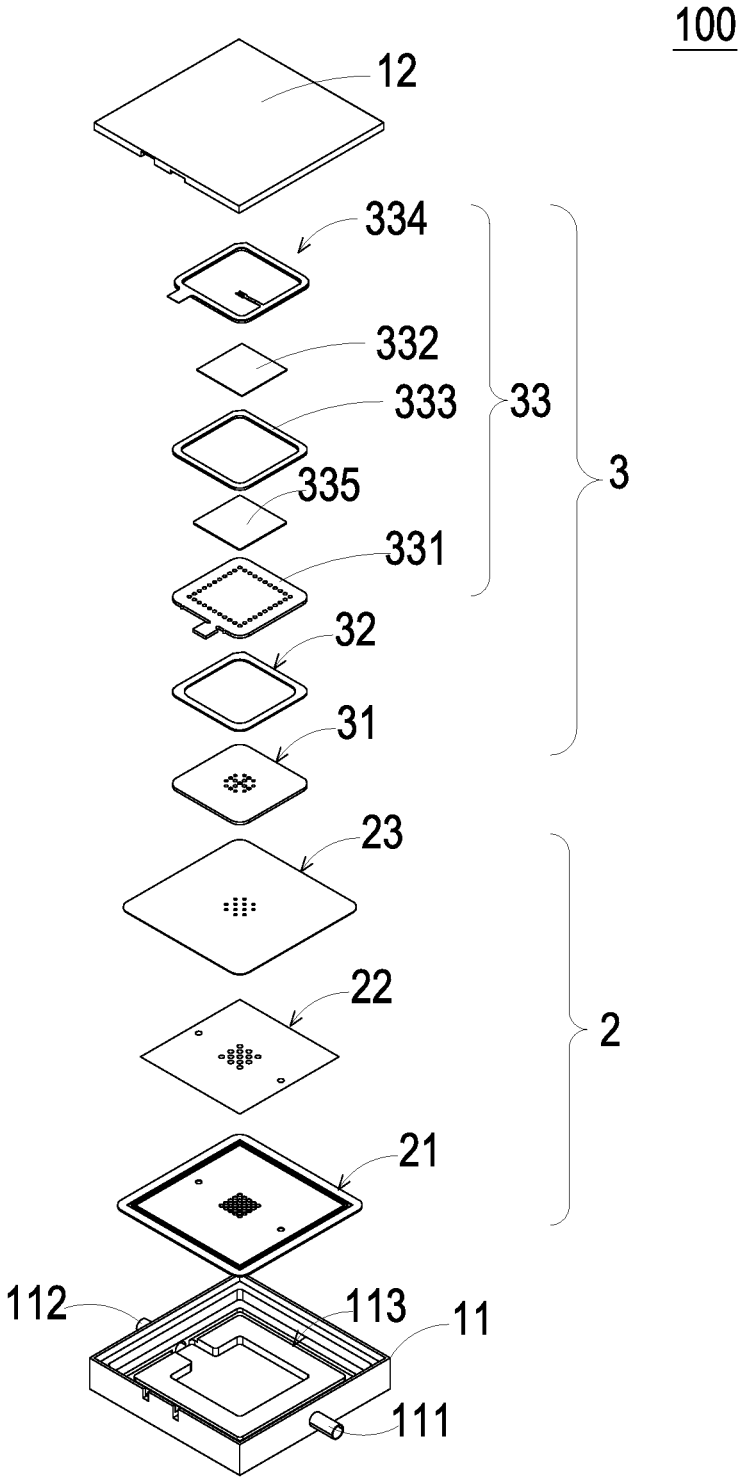
FIG. 5 a schematic exploded view illustrating a gas transportation device according to another embodiment of the present disclosure.

Please refer to FIG. 5. In another embodiment, the gas transportation device 100 further includes a cushion plate 335. The cushion plate 335 is disposed between the piezoelectric plate 332 and the gas inlet plate 331 for adjusting the resonance frequency between the piezoelectric plate 332 and the gas inlet plate 331.

In the embodiment, the valve body 2 is formed by the gas outlet plate 21, the valve plate 22 and the first plate 23. Preferably but not exclusively, the total flow rate of the fluid in the valve body 2 can be designed and realized according to the diameter or the number of the outlet apertures 211, the valve openings 221 and the first orifices 231. Please refer to Table 2. The relationships among the diameters and the numbers of the outlet apertures 211, the valve openings 221 and the first orifices 231 are listed in Table 2, so as to achieve the optimized effect of the high-flow gas transportation device 100.

TABLE 2

| | Diameter of the outlet aperture | | | | | | | |
|---|---|---|---|---|---|---|---|---|
| | 100 μm | 200 μm | 300 μm | 400 μm | 500 μm | 600 μm | 700 μm | 800 μm |
| Number of the outlet apertures | 49 | 49 | 36 | 36 | 25 | 25 | 25 | 25 |
| Number of the valve openings | 24 | 24 | 18 | 18 | 12 | 12 | 12 | 12 |
| Number of the first orifices | 20 | 20 | 18 | 18 | 12 | 10 | 10 | 10 |

Moreover, in the specific embodiment of the present disclosure, the valve body 2 is formed by the gas outlet plate 21, the valve plate 22 and the first plater 23. It has been considered that the valve plate 22 is a flexible membrane with the thickness ranged from 0.4 μm to 0.6 μm, and the gap G maintained between the valve plate 22 and the recessed portion 212 of the gas outlet plate 21 are ranged from 40 μm to 70 μm. Therefore, the piezoelectric plate 332 of the actuating component 33 is maintained at a working frequency ranged from 20 kHz to 22 kHz. Preferably but not exclusively, the working frequency of the piezoelectric plate 23 is 21 kHz, the amplitude of oscillation is maintained at 30 μm, and the valve plate 22 of 3 μm is disposed on the recessed portion 212 of the gas outlet plate 21 with the gap G ranged from 40 μm to 70 μm. In such configuration, the piezoelectric plate 332 is vibrated within the gap G to generate a unidirectional drainage of a rarefaction wave, so as to achieve the optimized effect of preventing the phenomenon of backflow and obtaining the maximum flow rate. It is important for maximizing valve performance to minimize the pressure drop that occurs as the gas flows through valve body 2.

In summary, the present disclosure provides a gas transportation device including a gas outlet plate, a valve plate, a first plate, a second plate and a square actuating component which are stacked and assembled in sequence. A valve body is configured by the valve plate, the first plate and the second plate collaboratively. The plurality of first orifices, the plurality of valve openings and the plurality of outlet apertures of the valve body are located below the actuation portion surrounded by the plurality of inlet apertures. When the piezoelectric plate drives the gas inlet plate to move, the gas is allowed to be downwardly transported rapidly, and the phenomenon of backflow is prevented through the structure that the plurality of first orifices and the plurality of valve openings are misaligned, so at to obtain a structure for providing high flow and avoiding the backflow. When an airflow is in the forward direction, the valve body is operated to open a flow path, and when the airflow is in the reverse direction, the valve body is operated to seal the flow path, thereby preventing the phenomenon of backflow, generating a unidirectional airflow and increasing the flow rate of the gas transportation device. The flow rate is increased substantially and the high-flow gas transportation device is achieved.

While the disclosure has been described in terms of the most practical and preferred embodiments, it is to be understood that the disclosure needs not be limited to the disclosed embodiments. On the contrary, it is intended to cover various modifications and similar arrangements included within the spirit and scope of the appended claims so as to encompass all such modifications and similar structures.

What is claimed is:

1. A gas transportation device, comprising:

an outer housing comprising a case and a top cover, wherein the case comprises an inlet end, an outlet end and an accommodation groove, the accommodation groove is in fluid communication with the inlet end and the outlet end, and the top cover is covered on the accommodation groove;

a valve body comprising a gas outlet plate, a valve plate and a first plate stacked sequentially and disposed within the accommodation groove, wherein the valve plate is located between the gas outlet plate and the first plate, wherein the gas outlet plate comprises a plurality of outlet apertures, the first plate comprises a plurality of first orifices, the valve plate comprises a plurality of valve openings, the plurality of valve openings are misaligned with the plurality of first orifices, and the plurality of valve opening are corresponding in position to the plurality of outlet apertures; and an actuator comprising a second plate, a frame and an actuating component, wherein the second plate is stacked and disposed on the valve body, the second plate comprises a plurality of second orifices, and the plurality of second orifices are corresponding in position to the plurality of first orifices, wherein the frame is stacked and disposed on the second plate, wherein the actuating component in a rectangular shape is stacked and disposed on the frame;

wherein when the actuator is driven, through the structure that the plurality of first orifices and the plurality of valve openings are misaligned, the valve body is operated to open a flow path when an airflow is in a forward direction, and the valve body is operated to seal the flow path when the airflow is in a reverse direction, wherein the actuating component comprises a gas inlet plate, a piezoelectric plate, an insulation frame, a conductive frame, wherein the gas inlet plate comprising a plurality of inlet apertures, wherein an actuation portion and a fixed portion are defined on a plane of the gas inlet plate through the positions of the plurality of inlet apertures, the actuation portion is surrounded by the plurality of inlet apertures, and the fixed portion is surrounding the periphery of the plurality inlet apertures; the piezoelectric plate disposed on the actuation portion of the gas inlet plate; the insulation frame disposed on the fixed portion of the gas inlet plate; the conductive frame disposed on the insulation frame;

wherein the conductive frame includes a conducting electrode and a conducting pin, the conducting electrode is electrically contacted with the piezoelectric plate the conducting pin is externally connected to a wire, the gas inlet plate is formed by a conductive material and in electrical contact with the piezoelectric plate, and a leading pin of the frame is connected to another wire, thereby the driving circuit of the actuating component is completed.

2. The gas transportation device according to claim 1, wherein the plurality of first orifices, the plurality of valve openings and the plurality of outlet apertures of the valve body are located below the actuation portion surrounded by the plurality of inlet apertures, wherein when the piezoelectric plate drives the gas inlet plate to move, through the structure that the plurality of first orifices and the plurality of valve openings are misaligned, the valve body is operated to open the flow path when the airflow is in the forward direction, and the valve body is operated to seal the flow path when the airflow is in the reverse direction.

3. The gas transportation device according to claim 2, wherein the case comprising a plurality of positioning protrusions disposed within the accommodation groove, each of the gas outlet plate, the valve plate and the first plate comprises a plurality of positioning holes, respectively, and each positioning hole is corresponding in position to the respective positioning protrusion, wherein the respective positioning holes of the gas outlet plate, the valve plate and the first plate are sleeved on the corresponding positioning protrusion, so as to be positioned and constitute the valve body.

4. The gas transportation device according to claim 2, wherein the gas outlet plate comprises a recessed portion recessed from a surface of the gas outlet plate and formed a depth, and the valve plate covers the gas outlet plate, so that a gap is maintained between the valve plate and the recessed portion of the gas outlet plate, and a ratio of the gap to the thickness of the gas outlet plate is ranged from 1:2 to 2:3.

5. The gas transportation device according to claim 4, wherein the gap is ranged from 40 μm to 70 μm.

6. The gas transportation device according to claim 2, wherein the valve plate is a flexible membrane, and the thickness of the valve plate is ranged from 0.4 μm to 0.6 μm.

7. The gas transportation device according to claim 2, wherein the valve plate is a polyimide membrane.

8. The gas transportation device according to claim 2, wherein the diameter of the valve opening is greater than the diameter of outlet aperture.

9. The gas transportation device according to claim 2, wherein the diameter of the valve opening is equal to the diameter of outlet aperture, and the diameter of the first orifice is equal to the diameter of the second orifice.

10. The gas transportation device according to claim 2, wherein the plurality of inlet apertures are tapered, and the number of the inlet apertures is an even number.

11. The gas transportation device according to claim 10, wherein the number of the inlet apertures is forty-eight or fifty-two.

12. The gas transportation device according to claim 2, wherein the plurality of inlet apertures are arranged in a rectangular shape on a plane of the gas inlet plate.

13. The gas transportation device according to claim 2, wherein the plurality of inlet apertures are arranged in a square shape on a plane of the gas inlet plate.

14. The gas transportation device according to claim 2, wherein the plurality of inlet apertures are arranged in a circular shape on a plane of the gas inlet plate.

15. The gas transportation device according to claim 2, wherein the actuation portion is square, and the piezoelectric plate is square.

16. The gas transportation device according to claim 2, further comprising a cushion plate disposed between the gas inlet plate and the piezoelectric plate, wherein the gas outlet plate, the first plate and the second plate are a metallic plate, respectively.

17. The gas transportation device according to claim 2, wherein the piezoelectric plate of the actuating component is maintained at a working frequency ranged from 20 kHz to 22 kHz.

18. The gas transportation device according to claim 2, wherein the diameter of the outlet aperture is 100 μm or 200 μm, the number of the outlet apertures is forty-nine, the number of the valve openings is twenty-four, and the number of the first orifices is twenty.

19. The gas transportation device according to claim 2, wherein the diameter of the outlet aperture is 300 μm or 400 μm, the number of the outlet apertures is thirty-six, the number of the valve openings is eighteen, and the number of the first orifices is eighteen.

20. The gas transportation device according to claim 2, wherein the diameter of the outlet aperture is 500 μm, the number of the outlet apertures is twenty-five, the number of the valve openings is twelve, and the number of the first orifices is twelve.

21. The gas transportation device according to claim 2, wherein the diameter of the outlet aperture is selected from the group consisting of 600 μm, 700 μm and 800 μm, the number of the outlet apertures is twenty-five, the number of the valve openings is twelve, and the number of the first orifices is ten.

* * * * *